US005514480A

United States Patent [19]

Takagi et al.

[11] Patent Number: 5,514,480

[45] Date of Patent: May 7, 1996

[54] METAL-BASED COMPOSITE

[75] Inventors: Katumi Takagi, Nagoya; Shuji Inoue, Anjo, both of Japan

[73] Assignee: Aisin Seiki Kabushiki Kaisha, Kariya, Japan

[21] Appl. No.: 286,179

[22] Filed: Aug. 5, 1994

[30] Foreign Application Priority Data

Aug. 6, 1993 [JP] Japan ..... 5-195970

[51] Int. Cl.[6] ..... B22F 3/04

[52] U.S. Cl. ..... 428/549; 428/551; 428/552; 428/553; 428/558; 428/559; 428/565; 428/650

[58] Field of Search ..... 428/548, 549, 428/551, 552, 553, 558, 559, 565, 567, 568, 539.5, 650

[56] References Cited

U.S. PATENT DOCUMENTS

| | | | |
|---|---|---|---|
| 3,019,514 | 2/1962 | Bickelhausp | 29/182.5 |
| 3,885,959 | 5/1975 | Badia et al. | 75/138 |
| 4,012,204 | 3/1977 | Riewald et al. | 29/191.2 |
| 4,023,252 | 5/1977 | Levinstein et al. | 428/650 |
| 4,053,011 | 10/1977 | Riewald et al. | 164/97 |
| 4,404,262 | 9/1983 | Watmough | 428/539.5 |
| 4,506,721 | 3/1985 | Ban et al. | 164/97 |
| 4,587,177 | 5/1986 | Toaz et al. | 428/614 |
| 4,740,428 | 4/1988 | Koike et al. | 428/549 |
| 4,798,770 | 1/1989 | Donomoto et al. | 428/547 |

FOREIGN PATENT DOCUMENTS

| | | |
|---|---|---|
| 2701421C2 | 12/1982 | Germany . |
| 2644272C2 | 1/1983 | Germany . |
| 3610856 | 10/1986 | Germany . |
| 5-24212 | 4/1993 | Japan . |

*Primary Examiner*—Donald P. Walsh
*Assistant Examiner*—Chrisman D. Carroll
*Attorney, Agent, or Firm*—Burns, Doane, Swecker & Mathis

[57] ABSTRACT

A metal-based composite includes a metal matrix including aluminum as a major component, discontinuous alumina fibers buried in the metal matrix, mullite particles buried therein, and solid lubricant particles buried therein. The solid lubricant particles can be either graphite particles with a nickel layer formed on a surface thereof, or boron nitride cermet particles. By thus including the specific solid lubricant particles, the wear resistance of the metal-based composite can be improved, the wear of its mating parts can be reduced, and the friction coefficient between the metal-based composite and the mating parts can be inhibited from fluctuating. Hence, the metal-based composite can appropriately make aluminum-based internal combustion engines.

3 Claims, 3 Drawing Sheets

METAL-BASED COMPOSITE

BACKGROUND OF THE INVENTION

1. Field of the Invention

The present invention relates to a metal-based composite having good wear resistance, being capable of reducing wear of its mating parts and including aluminum as a major component. The metal-based composite can be applied to cylinder blocks, pistons or the like.

2. Description of the Related Art

As a conventional engineering technique relating to metal-based composites, a metal-based composite has been known which is made, as disclosed in Japanese Examined Patent Publication (KOKOKU) No. 5-24,212, by compositing an aluminum-based metallic matrix with carbon fibers which are treated with an SiO gas. In the metal-based composite, as set forth in the publication, the carbon fibers are treated with an SiO gas to form $SiO_2$ on their surface. Accordingly, a molten aluminum is inhibited from reacting with the carbon fibers and from forming $Al_4C_3$. Thus, a metal-based composite of high strength can be produced. However, the publication does not discuss sliding characteristics of the metal-based composite.

When a metal-based composite for application to sliding parts is prepared by mixing ceramic particles, discontinuous fibers or the like, the mating parts are fiercely attached and so it wears them increasingly.

SUMMARY OF THE INVENTION

The present invention has been developed in view of the circumstances described above. It is therefore an object of the present invention to complete a metal-based composite having good wear resistance and being capable of reducing wear of its mating parts by investigating a wide variety of solid lubricants to be compounded in metal-based composite.

A metal-based composite according to the present invention comprises a metal matrix including aluminum as a major component, discontinuous alumina fibers buried in the metal matrix, mullite particles buried therein, and solid lubricant particles buried therein.

The metal matrix constituting the present metal-based composite can be either aluminum or aluminum alloy. As for the aluminum alloy, it is preferred to use a high-silicon-content Al-Si alloy which is superb in terms of its sliding properties such as wear resistance and the like.

Discontinuous alumina fibers, the mullite particles and the solid lubricant particles are buried in the metal matrix. The discontinuous alumina fibers can be either alumina whiskers or poly-crystalline alumina fibers. It is preferred that the discontinuous alumina fibers have a length of from 20 to 450 micrometers (an average length of 80 micrometers), and a diameter of from 1 to to 12 micrometers (an average diameter of 3 micrometers).

As for the mullite particles, it is preferred that the mullite particles have a particle diameter of from 10 to 150 micrometers (an average particle diameter of 30 micrometers).

As for the solid lubricant particles, it is possible to use either graphite particles with a nickel layer formed on a surface thereof, or boron nitride cermet particles (hereinafter simply referred to as "BN cermet particles").

The graphite particles preferably have a particle diameter of from 30 to 100 micrometers (an average particle diameter of 50 micrometers), and their nickel layer preferably has a thickness of from 10 to 20 micrometers (an average thickness of 15 micrometers).

The BN cermet particles are boron nitride which has a hexagonal system crystalline structure, and they preferably have a particle diameter of from 30 to 100 micrometers (an average particle diameter of 50 micrometers).

As for the proportions of the components to be compounded in the present metal-based composite, the discontinuous alumina fibers are preferably compounded in an amount of from 5 to 10% by volume (an average amount of 7% by volume), the mullite particles are preferably compounded in an amount of from 5 to 15% by volume (an average amount of 10% by volume), and the solid lubricant particles are preferably compounded in an amount of from 1 to 8% by volume (an average amount of 2% by volume).

A process for producing a metal-based composite according to the present invention comprises the steps of forming a mixture including discontinuous alumina fibers, mullite particles and solid lubricant particles into a predetermined shape so as to prepare a formed mixture, heating the formed mixture to a predetermined temperature and placing the heated formed mixture in a cavity of a casting mold heated preliminarily, and charging a molten metal including aluminum as a major component in the cavity, filling up spaces in the formed mixture and solidifying the molten metal, thereby preparing a metal-based composite.

The step of forming a mixture including discontinuous alumina fibers, mullite particles and solid lubricant particles into a predetermined shape so as to prepare a formed mixture can be preferably achieved by the following series of steps: (a) mixing water with the discontinuous alumina fibers, the mullite particles, the solid lubricant particles and an inorganic binder (if necessary), (b) further mixing the mixture by stirring, (c) forming the mixture by suctioning and dewatering, and (d) further dewatering the mixture by burning.

As for the casting mold, it is preferable to use a mold applicable to aluminum casting. In particular, it is further preferable to use a mold for pressurized casting. The pre-heating of the formed mixture is carried out in order to inhibit the molten aluminum from cooling and solidifying. With this arrangement, the molten aluminum is kept in a liquid state until it fully permeates into the spaces in the formed mixture and it completely covers the formed mixture. The pre-heating of the casting mold is also carried out in order to prevent the molten aluminum from being cooled rapidly.

Moreover, it is preferred to charge the molten aluminum under pressure. With this arrangement, the molten aluminum can permeate further securely into the spaces in the formed mixture. Consequently, the molten aluminum can solidify after it fully permeates into the spaces in the formed mixture. Thus, the present process can produce the present metal-based composite.

In the present metal-based composite, the specific solid lubricant particles are added, for example, to a metal-based composite which comprises the metal matrix including aluminum as a major component, the discontinuous alumina fibers and the mullite particles. With this arrangement, the present metal-based composite is improved in terms of the wear resistance, and at the same time it can exhibit a friction coefficient which is inhibited from increasing or fluctuating. In particular, when the graphite particles coated with nickel are added to the present metal-based composite as the solid lubricant particles, the resulting present metal-based composite exhibits a friction coefficient which is less likely to fluctuate and whose value itself is small. Further, when the BN cermet particles are added to the present metal-based composite as the solid lubricant particles, the resulting present metal-based composite exhibits a friction coefficient which is equivalent to that of cast iron.

As a result, as compared to the conventional metal-based composites comprising a metal matrix including aluminum as a major component, the present metal-based composite is remarkably less likely to adhere onto its mating parts, and it has a superb wear resistance. Hence, the present metal-based composite is an optimum material, for instance, for making cylinders, pistons or the like for internal combustion engines.

In particular, when the solid lubricant particles are the graphite particles with the nickel layer formed on the surface, the presence of the nickel layer inhibits the graphite particles from oxidizing, and it prohibits them from disappearing during the pre-heating of the formed mixture. Accordingly, the graphite particles can be securely compounded in the predetermined amount.

As having been described so far, by adding the specific solid lubricant particles to the present metal-based composite in accordance with the present invention, it is possible to reduce the wear of the mating parts of the present metal-based composite and to make the friction coefficient of the present metal-based composite less likely to fluctuate. As a result, it is possible to use the present metal-based composite as a material for making the aluminum-based internal combustion engines.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

(Production of Metal-based Composites)

In the Preferred Embodiments hereinafter described, the following additives were employed: delta-phase discontinuous alumina fibers having an average length of 80 micrometers and an average diameter of 3 micrometers; mullite particles having a particle diameter of from 10 to 150 micrometers (an average particle diameter of 30 micrometers); graphite particles having a particle diameter of from 10 to 60 micrometers and with a nickel layer of about 15 micrometers average thickness formed on their surface; BN cermet particles having an average particle diameter of 30 micrometers. As for an aluminum-based metal matrix, an aluminum alloy having the composition of ADC12 as per JIS (Japanese Industrial Standard) was employed.

A formed mixture for metal-based composite No. 1 was prepared in the following manner. Namely, 7 parts by volume of the discontinuous alumina fibers, 10 parts by volume of the mullite particles and 5 parts by volume of the nickel-plated graphite particles as the solid lubricant particles were mixed with water substantially uniformly. Then, the mixture was formed by suctioning and dewatering, thereby preparing the formed mixture.

A formed mixture for metal-based composite No. 2 was prepared in the following manner. Namely, 7 parts by volume of the discontinuous alumina fibers, 10 parts by volume of the mullite particles and 5 parts by volume of the BN cermet particles as the solid lubricant particles were mixed with water substantially uniformly. Then, the mixture was formed by suctioning and dewatering, thereby preparing the formed mixture.

A formed mixture for metal-based composite No. 3 was prepared as a comparative example, and it was comprised of 7 parts by volume of the discontinuous alumina fibers and 10 parts by volume of the mullite particles. The mixing of the additives and the forming of the formed mixture were carried out in the same manner as the above-described formed mixtures.

Figure 2:
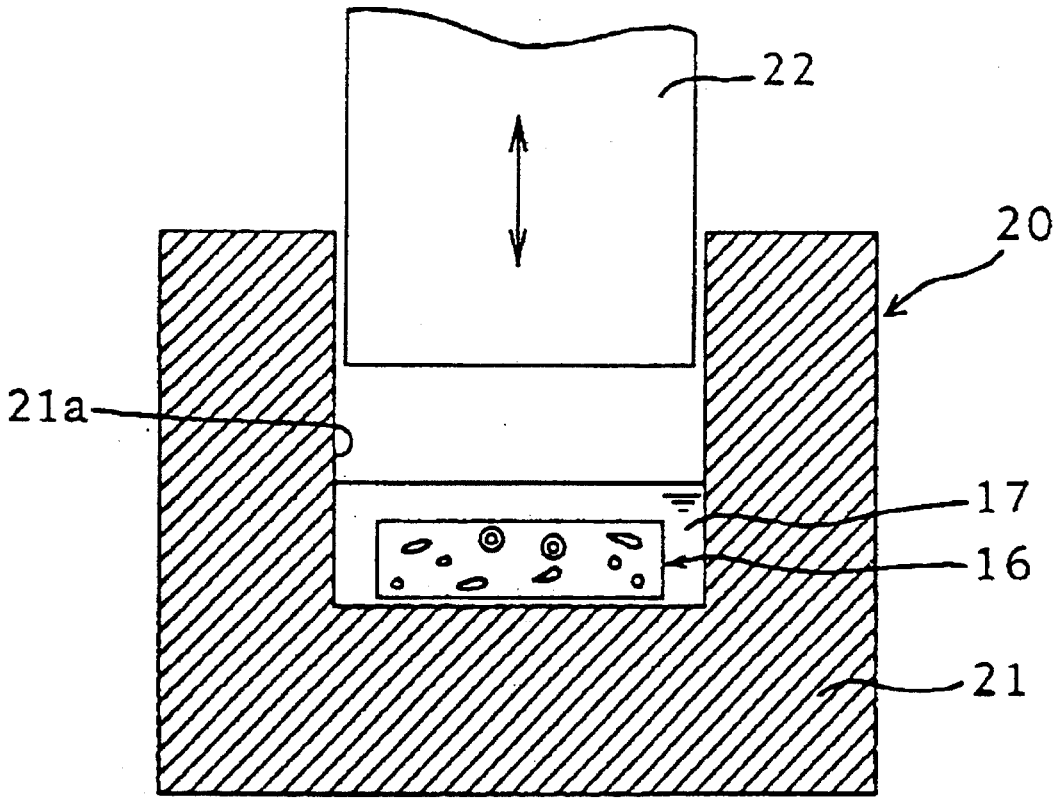
FIG. 2 is a schematic cross-sectional view for illustrating a casting apparatus which was used to produce the metal-based composite of the preferred embodiment.

These three formed mixtures were pre-heated to 700° C. in air, and they were placed in a cylinder-shaped lower mold 21, respectively, as schematically illustrated in FIG. 2. The lower mold 21 constituted a high pressure casting mold made of steel, and it was heated to 200° C. preliminarily. Then, the aforementioned molten aluminum 17 heated to 750° C. was charged in the lower mold 21. Thereafter, a piston-shaped upper mold 22 was descended by means of hydraulic pressure. The upper mold 21 constituted the same high pressure casting mold made of steel. Thus, the charged molten aluminum 17 was pressurized under a pressure of about 500 kgf/cm$^2$, thereby permeating the molten aluminum 17 in the spaces in the formed mixture 16. While maintaining the pressurized state, the lower mold 21 was cooled with air, thereby solidifying the molten aluminum 17. Finally, the upper mold 22 was ascended in order to take out the resulting metal-based composite. Thus, three metal-based composites No. 1, No. 2 and No. 3 were produced.

Figure 1:
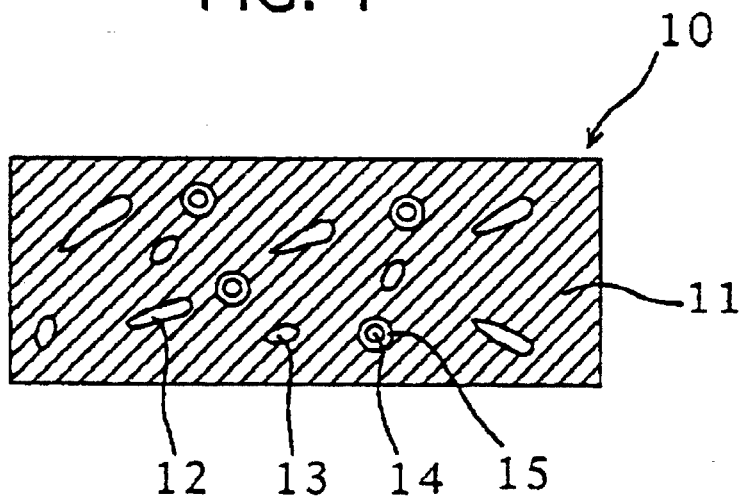
FIG. 1 is schematic cross-sectional view of a metal-based composite of a preferred embodiment according to the present invention.

Metal-based composite No. 1 was comprised of the discontinuous alumina fibers in an amount of 7% by volume, the mullite particles in an amount of 10% by volume, the nickel-plated graphite particles in an amount of 5% by volume and the balance of the aluminum alloy. FIG. 1 schematically illustrates a rough structure of metal-based composite No. 1. In FIG. 1, metal-based composite No. 1 is designated at 10, the aluminum alloy constituting the matrix is designated at 11, the discontinuous alumina fibers are designated at 12, the mullite particles are designated at 13, the graphite particles are designated at 14, and the nickel plating layer is designated at 15.

Metal-based composite No. 2 was comprised of the discontinuous alumina fibers in an amount of 7% by volume, the mullite particles in an amount of 10% by volume, the BN cermet particles in an amount of 5% by volume and the balance of the aluminum alloy.

Metal-based composite No. 3 was comprised of the discontinuous alumina fibers in an amount of 7% by volume, the mullite particles in an amount of 10% by volume and the balance of the aluminum alloy.

(Sliding Properties Test on the Resulting Metal-based Composites)

Traditionally conventional metal-based composites have been examined for their sliding properties with the LFW wear testing machine. However, the LFW wear testing machine produces sliding phenomena which are different from actual engines. Therefore, it is difficult to regard the sliding properties exhibited by the metal-based composites on the LFW wear testing machine as those exhibited by them on the actual engines. Accordingly, the present inventors developed a vertically reciprocative sliding wear testing machine which can be regarded as producing the sliding conditions virtually approximated to those on the actual engines, and they examined the metal-based composites No. 1, No. 2 and No. 3 for their sliding properties, e.g., the wear resistance, the friction coefficient and the adhesion preventability, on the vertically reciprocative sliding wear testing machine. Moreover, the metal-based composites No. 1, No. 2 and No. 3 were measured for their apparent hardness in Hv.

Figure 3:
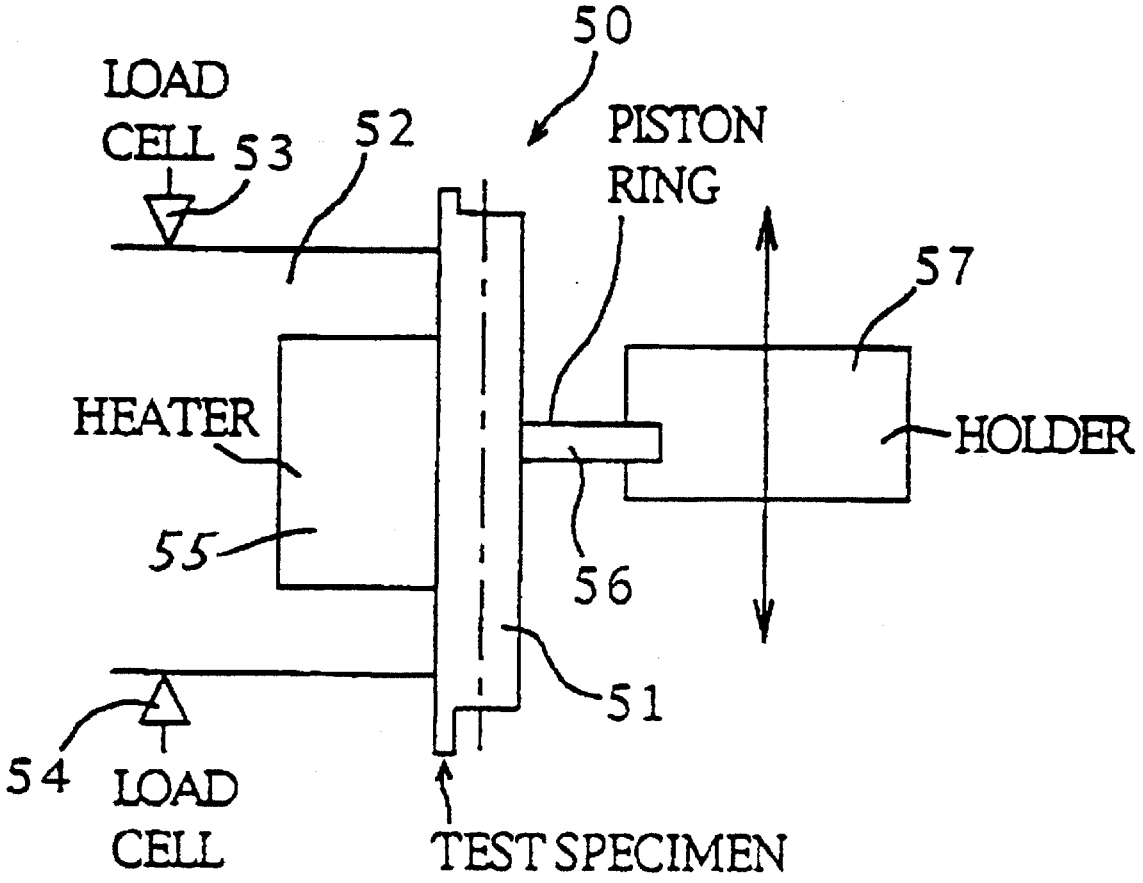
FIG. 3 is a schematic diagram for illustrating a vertically reciprocative sliding wear testing machine which was used to evaluate the metal-based composite of the preferred embodiment.
Figure 4:
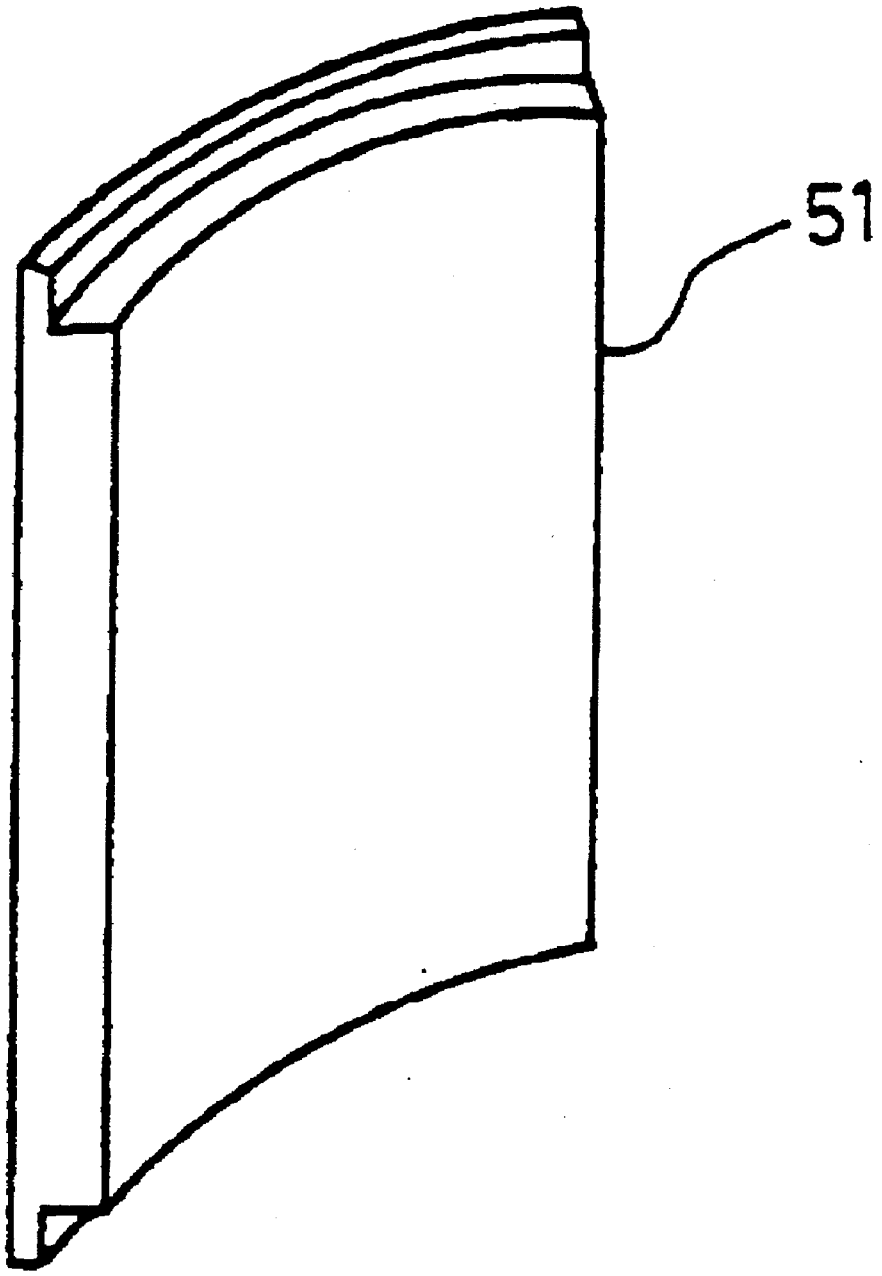
FIG. 4 is a perspective view for illustrating a test specimen which was tested on the vertically reciprocative sliding wear testing machine.

FIG. 3 schematically illustrates a major portion of the vertically reciprocative sliding wear testing machine. This vertically reciprocative sliding wear testing machine 50 employed a test specimen 51 illustrated in FIG. 4 and simulating an inner wall surface of an engine cylinder. As schematically illustrated in the perspective view, the test specimen 51 had a size of 61 mm in height, 30 mm in width and 5 mm in thickness, and it had a curved surface having a radius of curvature R42 in the width-wise direction. Thus, the test specimen 51 was formed so as to simulate a part of an inner peripheral surface which was cut out of an engine cylinder having a radius of 42 mm.

The vertically reciprocative sliding wear testing machine 50 was designed in the following manner: It could hold the test specimen 51 on a testing bench 52 which could move parallel in the vertical direction, it could detect pressing forces acting on the testing bench 52 in the upper direction and in the lower direction by load cells 53, 54, respectively, and it could heat the test specimen 51 to a predetermined temperature by a heater 55 disposed on the rear side of the test specimen 51.

As for a mating part in the sliding wear test, a piston ring 56 for an ordinary piston was used. Specifically speaking, the piston ring 56 was made of steel (e.g., SWOSC as per JIS), and it was plated with hard chromium on the surface.

During the sliding wear test, the piston ring 56 was fixed to a holder 57. The holder 57 was subjected to a pressing force of 2 kgf in order to perpendicularly bring the piston ring 56 into contact with the curved surface of the test specimen 51. Then, the holder 57 was slid vertically on the test specimen 51 over a stroke of 40 mm, and it was reciprocated 200 times per minute for a period of 70 minutes in order to carry out the sliding wear test. Thus, the test specimen 51 and the piston ring 56 are designed to constitute a relationship which can simulate the sliding between a cylinder and a piston in an engine. In addition, the temperature of the test specimen 51 was adjusted to 100° C., and the sliding operation was carried out under no lubrication.

The tested properties involved wear of the test specimen 51 and wear of the piston ring 56, and the friction coefficient between them. The wears were measured in terms of the worn thickness. The friction coefficient was derived from the stresses acting on the two load cells. The results of the measurements are set forth in Table 1 below. Since the sliding wear test was carried out in the reciprocative sliding manner, the friction coefficient varied. Namely, in every reciprocative movement, the friction coefficient exhibited the minimum value and the maximum value. Hence, the minimum value and the maximum value themselves are recited in Table 1 as the friction coefficient. Moreover, in the horizontal column designated with "Wear, Test Specimen ($mg/mm^2$)" of Table 1, the values mean as recited in the following parenthesized notation: (wear/specific wear). The specific wear herein means a value, the wear divided by the specific weight (i.e., wear/specific wear).

TABLE 1

| Identification | No. 1 | No. 2 | No. 3 |
|---|---|---|---|
| Wear, Test Specimen ($mg/mm^2$) | 36.2/12.61 | 11.1/3.80 | 14.7/5.25 |
| Wear, Piston Ring ($mg/mm^2$) | 0.1 | * | 0.1 |
| Friction Coefficient | 0.00–0.10 | 0.15–0.25 | 0.12–0.25 |
| Abrupt Friction Coefficient Increment | None | None | None |
| Hardness (Hv) | 155 | 142 | 145 |

Note:
In the horizontal column designated with "Wear, Piston Ring ($mg/mm^2$)," the mark "*" means a weight increment.

The following can be appreciated from Table 1. Metal-based composite No. 1 had a hardness of 155 Hv, and it exhibited a relatively high wear in the order of 36.2/12.61 $mg/mm^2$. However, its mating part exhibited a low wear of 0.1 $mg/mm^2$. In particular, it exhibited a remarkably low friction coefficient of 0.00–0.10. In addition, it did not show a large variation in the friction coefficient during the sliding wear test. Metal-based composite No. 2 had a hardness of 142 Hv, and it exhibited an extremely low wear in the order of 11.1/3.80 $mg/mm^2$. On the other hand, its mating part exhibited a remarkably low wear of 0.0 $mg/mm^2$. Further, it exhibited an ordinary friction coefficient of 0.15–0.25. Furthermore, it did not show a large variation in the friction coefficient during the sliding wear test.

Metal-based composite No. 3 was tested as a comparative example. It had a hardness of 145 Hv, and it exhibited a relatively low wear in the order of 14.7/5.25 $mg/mm^2$. On the other hand., its mating part exhibited a low wear of 0.1 $mg/mm^2$. Further, it exhibited an ordinary friction coefficient of 0.12–0.25. Furthermore, it did not show a large variation in the friction coefficient during the sliding wear test.

It should be noted that metal-based composite No. 1 exhibited the extremely low friction coefficient. This advantageous property is assumed to result from the operation of the nickel-plated graphite particles compounded in the metal-based composite. Nickel and aluminum have a high affinity with each other. Accordingly, there are formed Ni-Al intermetallic compounds between the nickel layer of the graphite particles and the molten aluminum. The Ni-Al intermetallic compounds exhibit such a high strength that they are believed to contribute to improving the strength of metal-based composite No. 1. Metal-based composite No. 1 thus exhibited the remarkably low friction coefficient. Focusing on this advantageous property, metal-based composite No. 1 is assumed to be an appropriate material for making high performance internal combustion engines which are operated under relatively mild sliding conditions.

Metal-based composite No. 2 should be mentioned specially for its small self-wear and the small wear of its mating part. The operation of the BN cermet particles used as the solid lubricant particles is believed to contribute to these advantageous properties. Namely, since the BN cermet has a hexagonal system crystalline structure, it is a stable phase of boron nitride at low pressures, it exhibits a favorable solid lubricating ability, and it is very stable chemically. In view of the extremely small self-wear and mating part wear, metal-based composite No. 2 is presumed to be an optimum material for making internal combustion engines which require durability.

Having now fully described the present invention, it will be apparent to one of ordinary skill in the art that many changes and modifications can be made thereto without departing from the spirit or scope of the present invention as set forth herein including the appended claims.

What is claimed is:

1. A metal-based composite, comprising a metal matrix that includes aluminum, discontinuous alumina fibers buried in said metal matrix in an amount of from 5 to 10% by volume, mullite particles buried in the metal matrix in an amount of from 5 to 15% by volume, and solid lubricant particles buried in the metal matrix in an amount of from 1 to 8% by volume.

2. A metal-based composite according to claim 1, wherein said solid lubricant particles are graphite particles with a nickel layer formed on a surface thereof.

3. A metal-based composite according to claim 1, wherein said solid lubricant particles are boron nitride cermet particles.

* * * * *